US005548964A

United States Patent [19]

Jinbo et al.

[11] Patent Number: 5,548,964

[45] Date of Patent: Aug. 27, 1996

[54] METHOD AND APPARATUS FOR COOLING A VACUUM DEVICE

[75] Inventors: Takeshi Jinbo, Ichihara; Hiroyuki Takahama, Sawara, both of Japan

[73] Assignee: Applied Materials, Inc., Santa Clara, Calif.

[21] Appl. No.: 266,039

[22] Filed: Jun. 27, 1994

[30] Foreign Application Priority Data

Jul. 29, 1993 [JP] Japan ..... 5-188363

[51] Int. Cl.[6] ..... B01D 8/00

[52] U.S. Cl. ..... 62/55.5; 417/901

[58] Field of Search ..... 62/55.5; 417/901

[56] References Cited

U.S. PATENT DOCUMENTS

| | | | |
|---|---|---|---|
| 3,137,551 | 6/1964 | Mark | 55/269 |
| 3,188,785 | 6/1965 | Butler | 55/269 |
| 3,423,947 | 1/1969 | Moniya | 62/3 |
| 3,464,223 | 9/1969 | Roberts et al. | 62/55.5 |
| 3,557,536 | 1/1971 | Ririe | 55/269 |
| 3,719,052 | 3/1973 | White | 62/55.5 |
| 3,785,162 | 1/1974 | Long et al. | 62/55.5 |
| 3,902,330 | 9/1975 | Power | 62/55.5 |
| 4,679,402 | 7/1987 | Andeen | 62/55.5 |
| 4,873,833 | 10/1989 | Pfeiffer et al. | 62/55.5 |
| 4,926,648 | 5/1990 | Okumura et al. | 62/55.5 |
| 5,062,271 | 5/1991 | Okumura et al. | 62/55.5 |
| 5,357,760 | 10/1994 | Higham | 62/55.5 |

FOREIGN PATENT DOCUMENTS

| | | |
|---|---|---|
| 0370702 | 5/1990 | European Pat. Off. . |
| 1938035 | 7/1969 | Germany . |

*Primary Examiner*—Ronald C. Capossela
*Attorney, Agent, or Firm*—Michael A. Glenn

[57] ABSTRACT

A cooling structure for a vacuum device includes an external frame portion positioned between vacuum chamber flange and cryopump flange; a cooling panel formed in a partition surrounded by said external frame, the cooling panel having an opening that allows a fluid flow between said vacuum chamber and said cryopump; a cooling means positioned in contact with an exposed peripheral cooling panel surface for cooling said cooling panel; and a coolant feeding means for supplying coolant to the cooling means.

13 Claims, 4 Drawing Sheets

METHOD AND APPARATUS FOR COOLING A VACUUM DEVICE

BACKGROUND OF THE INVENTION

1. Technical Field

The present invention relates to the cooling of vacuum devices. More particularly, the present invention relates to a method and apparatus for cooling a thermal load in a vacuum device that results from such factors as gas flow from a vacuum chamber to an exhaust pump.

2. Description of the Prior Art

A vacuum pump, such as the cryopump 3 shown in FIG. 1, is used in the prior art to evacuate a process gas from a vacuum chamber 2 and thereby maintain a stable, selected vacuum in the interior of the vacuum chamber, while constantly purging the chamber of expended process gases. Because the cryopump requires specific operating conditions, it is usually necessary to reduce the thermal load on cryopump. For example, heat transfer to the cryopump from the process gas may be prevented by a heat shield 41, which absorbs heat from the gas, as well as any radiation heat. The heat shield 41 is cooled by a flow of cooling water, thereby increasing the heat shield cooling efficiency.

It is necessary to position a cooling pipe 42 within the vacuum chamber to provide a flow of coolant to cool the heat shield 41 because the heat shield is located within the vacuum chamber. Consequently, it is necessary to provide openings in the outer wall of the vacuum chamber to allow the cooling pipe 42 to be admitted into the vacuum chamber. The openings must be airtight under vacuum conditions and therefore must include a seal 43 to maintain the vacuum within the vacuum chamber interior. Because the vacuum chamber is used for extended periods of time, the seal 43 is subjected to repeated stress and is easily damaged, such that ambient air leaks through the openings, preventing maintenance of a vacuum in the vacuum chamber.

Because a seal 43 is needed, the vacuum chamber configuration can become complicated. For example, even when it is only necessary to repair the vacuum chamber heat shield 41 and cooling pipe 42, it is still necessary to exchange the entire vacuum chamber. Furthermore, if the cooling pipe is damaged, then cooling water may leak into the vacuum chamber, damaging both the chamber and any work in progress.

It would be advantageous to provide a simple, high integrity system for cooling a vacuum system that did not suffer from the above limitations.

SUMMARY OF THE INVENTION

The present invention solves the problems of prior art vacuum cooling systems by providing a new cooling structure for vacuum equipment. The invention provides a cooling structure for a vacuum system, including a vacuum chamber having a vacuum chamber flange; a suction pump having a suction pump flange; an external frame, which is also used as a fixing seal, having at least a portion of its peripheral surface exposed; a cooling panel, positioned in a partition that surrounds the external frame, and having an opening formed therethrough to allow a fluid flow between the vacuum chamber and the suction pump; and a cooling means which is adapted to cool the cooling panel. The external frame portion of the cooling panel is positioned between the vacuum chamber flange and the suction pump flange, such that the vacuum chamber is readily sealed under high vacuum operating conditions. The fluid flow opening formed through the partition promotes cooling of a fluid passing therethrough.

The cooling means preferably consists of a cooling pipe arranged to make contact with the exposed peripheral cooling panel frame surface, and a coolant circulating means for supplying coolant to the cooling pipe. The cooling means may alternatively consist of a pipe having an opening inside the cooling panel. The cooling pipe is arranged on the outside of the vacuum chamber. Thus, if the cooling pipe is broken, no coolant can leak into the vacuum chamber.

DETAILED DESCRIPTION OF THE INVENTION

Figure 1:
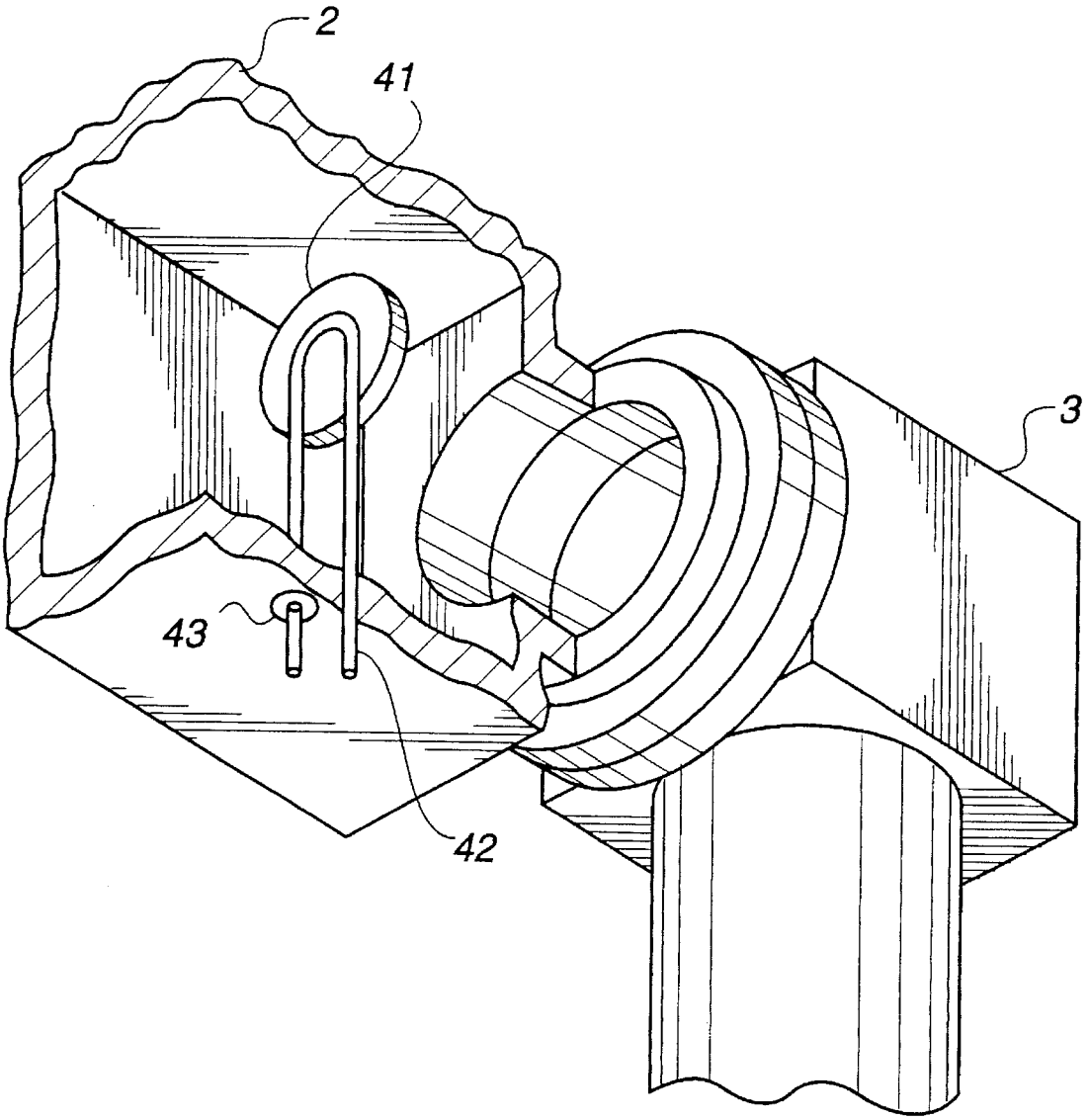
Fig. 1 (PRIOR ART)
FIG. 1 is a partially cut oblique view illustrating the cooling structure of a prior art vacuum device.
Figure 2:
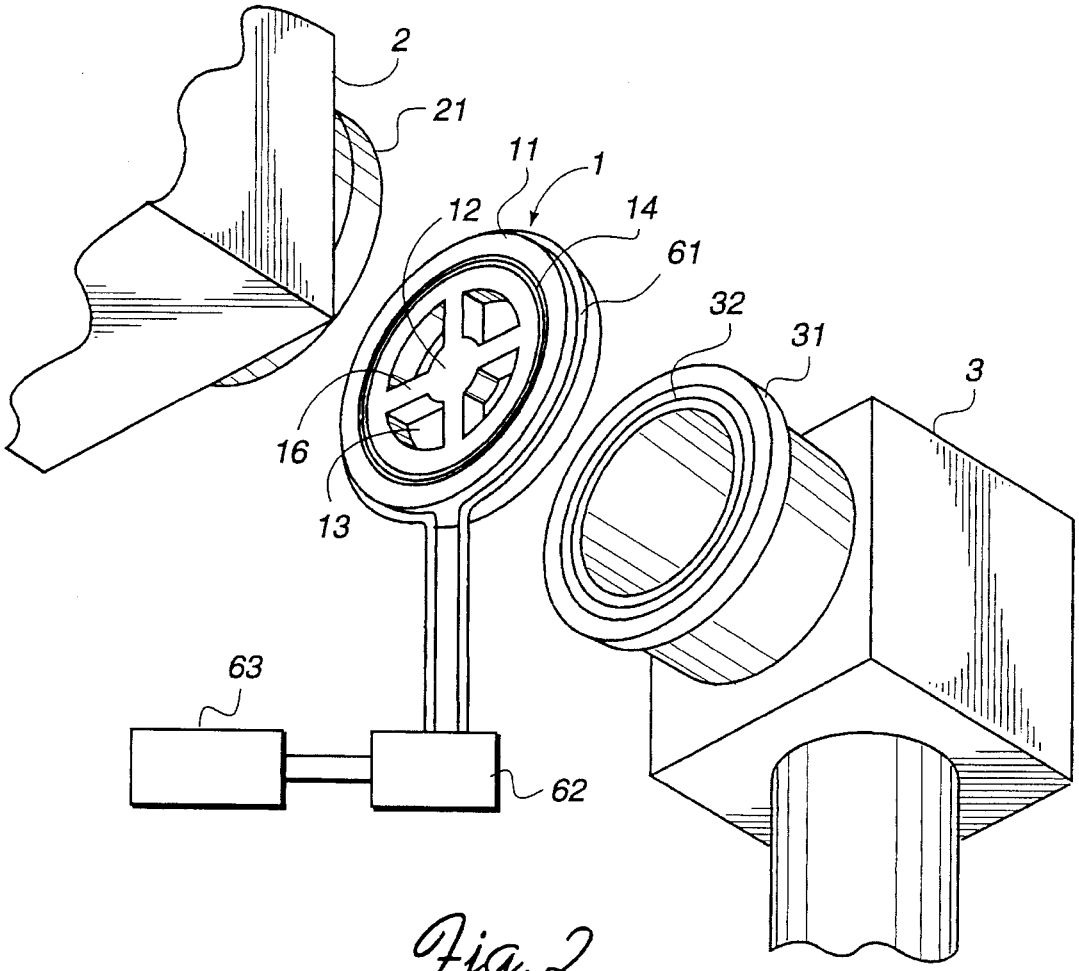
FIG. 2 is an exploded view illustrating a cooling structure of a vacuum device in accordance with the invention.

FIG. 2 is an exploded view of the cooling structure of a vacuum device in accordance with the invention. As shown in the figure, a cooling panel 1 is sandwiched between a vacuum chamber 2 flange 21 and a cryopump 3 flange 31. A cooper cooling pipe 61 is positioned in intimate contact with a cooling panel peripheral surface. The cooling pipe 61 is connected via a circulating pump 62 to coolant tank 63. A heat exchanger (not shown in the figure) that dissipates heat collected by the coolant fluid is positioned between the circulating pump 62 and the cooling pump 61.

It should be appreciated that the cooling pipe need not be made of copper, but may be made of any other thermally conductive material. While copper is also used in manufacturing the external frame portion and partition portion of the cooling panel, other materials may be used as well. The materials used in manufacturing the external frame portion and partition portion of the cooling panel and the cooling pipe may be different from each other. Additionally, although the coolant in the exemplary embodiment of the invention is water, other coolant fluids, including gases and liquids, such as nitrogen gas, and freon, may be used when practicing the invention.

Figure 3:
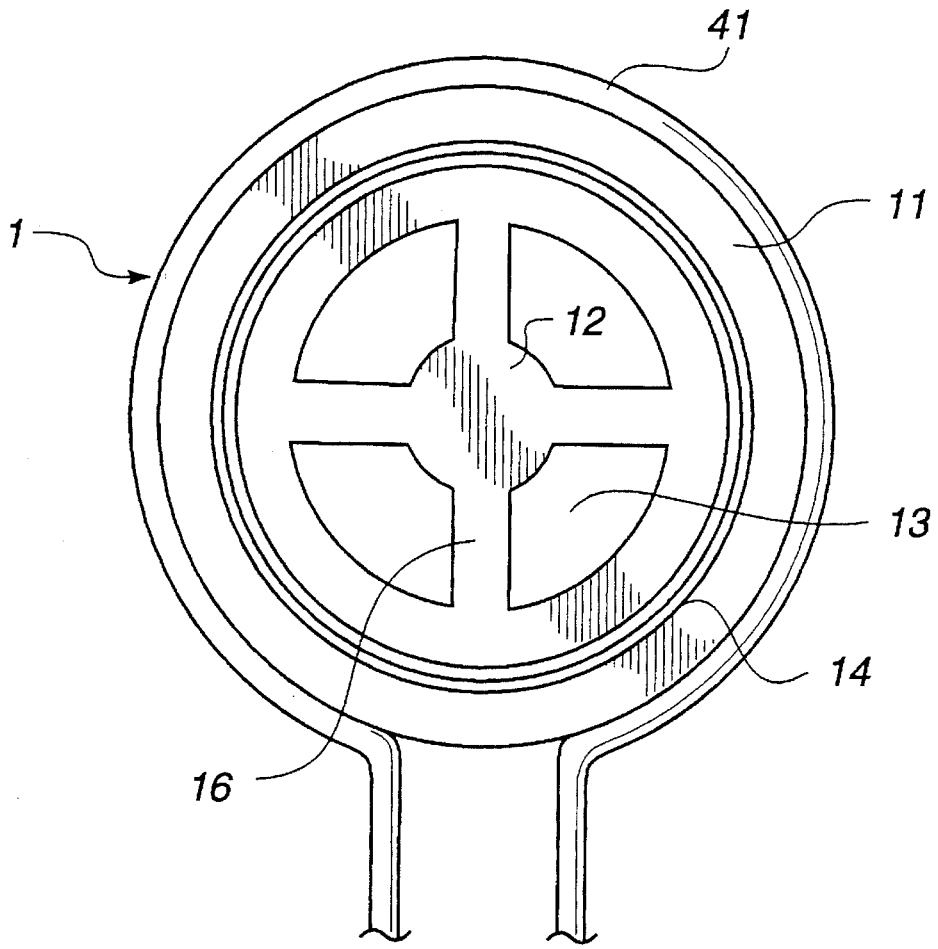
FIG. 3 is a top plan view illustrating a cooling panel for use with a vacuum chamber in accordance with the invention.

FIG. 3 is a top plan view of a cooling panel for use with a vacuum chamber in accordance with the invention. As shown in FIGS. 2 and 3, the cooling panel 1 is made from a circular copper plate which is processed to leave an external frame portion 11 in contact with the vacuum chamber flange 21 and cryopump flange 31, a central panel 12, and four supporting bars or spokes 16 that connect the central panel to the external flange 11. The cooling panel defines four fan-shaped windows 13 that are formed therethrough. The central panel 12 is configured such that it does not contact the flanges 21 and 31. Thus, the four supporting bars 16 form a partition. In this configuration, the partition defines openings that allow a fluid flow therethrough, such that the fluid is cooled as it passes through the openings, and comes into contact with the surfaces of the partition.

Figure 4:
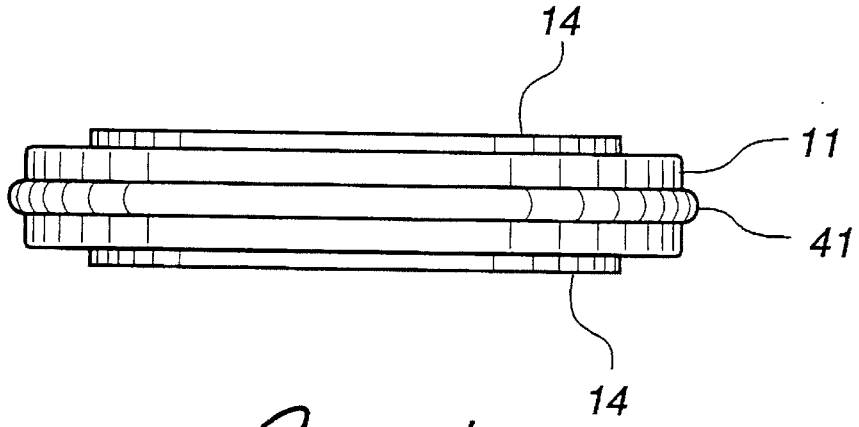
FIG. 4 is a side view of the cooling panel of FIG. 3.

FIG. 4 is a side view of the cooling panel of FIG. 3. Ring-shaped bumps 14 that act as gaskets are formed on the outer surface and inner surface of the cooling panel external frame 11. The bumps 14 are adapted for complementary engagement with a groove (not shown on the figure) formed on the vacuum chamber flange 21, and with a groove 32 formed on the cryopump flange 31. Such engagement seals the cooling panel frame to the vacuum chamber and cryopump, and thereby prevents penetration of the ambient into the vacuum chamber interior, while also preventing leakage of the fluid within the vacuum chamber to the ambient. Thus, the cooling panel external frame 11 form a seal between the cooling panel and vacuum chamber flange 21 and cryopump flange 31.

The fluid inside the vacuum chamber 2 is exhausted from the chamber by the cryopump 3. The fluid flows through an opening 13 arranged on the cooling panel. As the fluid flows through the window 13, heat is removed from the fluid by contact between the fluid and the cooling panel, especially from the partition comprising the central panel 12 and the four supporting bars or spokes 16. Heat is removed from the cooling panel by a coolant that is circulated in the cooling pipe 61 which is arranged on the cooling panel peripheral surface. Accordingly, ca fluid flowing through the opening in the cooling panel is continuously cooled.

The coolant flows from a water tank 63 to a circulating pump 62, and thereafter through the cooling pipe 61. Heat is released from the coolant when the coolant flows through the heat exchanger. The coolant is then recirculated to remove heat from cooling panel. This operation is repeated, the fluid is exhausted by the cryopump 3 from the vacuum chamber 2 and cooled. Radiated heat is also removed from the vacuum chamber in this way. Because the gas can be cooled and radiated heat can also be removed from the vacuum chamber, this configuration is particularly useful in applications having a high thermal load.

The cooling panel external frame 11 also functions as a fixing seal. It is therefore possible to circulate the cooled fluid to the cryopump 3, while preventing entry of the ambient into the vacuum chamber. Because the cooling panel 1 is arranged between the vacuum chamber flange 21 and the cryopump flange 31, it is easily installed between the vacuum chamber and the cryopump. Accordingly, if it is necessary to service the cooling panel, or if the cooling panel is to be mounted from a rear side, the cooling panel is easy to install, remove, and reinstall without exchanging or modifying the vacuum chamber. There is no need to arrange a heat shield or other unit in the vacuum chamber as is necessary in prior art cooling systems. Accordingly, the invention provides a vacuum system in which the configuration of vacuum chamber itself is simple. Finally, because the cooling pipe 61 is arranged on the peripheral surface of the cooling panel/fixing seal 1, in the event of a broken cooling pipe 61, the coolant will not leak into vacuum chamber.

Figure 5:
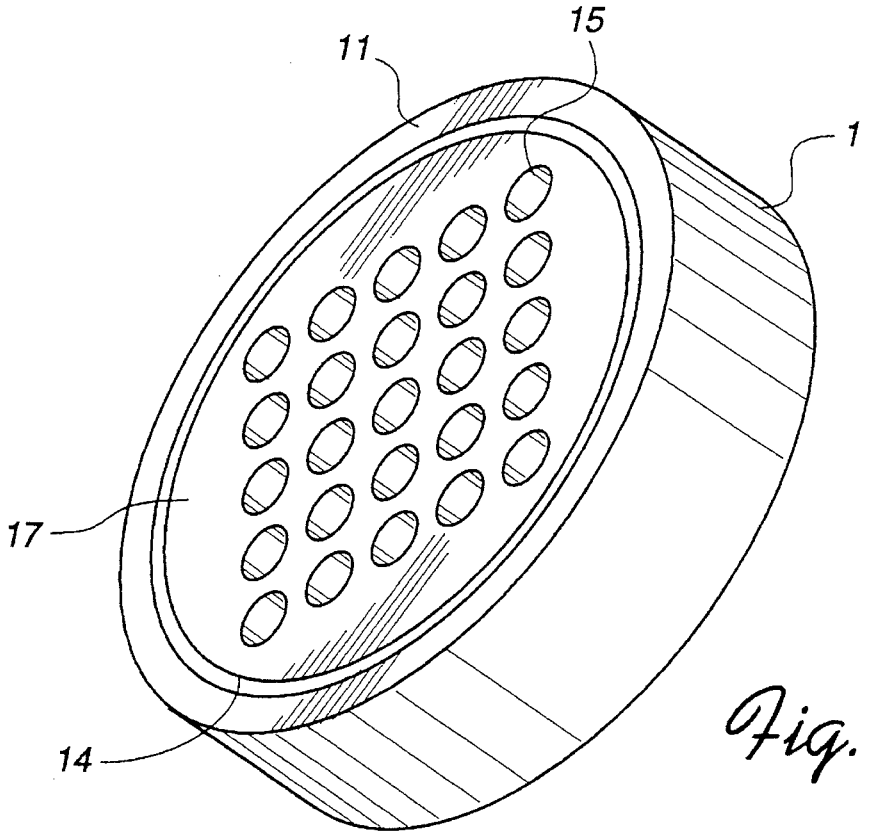
FIG. 5 is an oblique view illustrating an alternative cooling panel for use with a vacuum chamber in accordance with the invention.

The profile of the cooling panel is not limited to that shown in FIGS. 2, 3, and 4. For example, FIG. 5 is an oblique view of an alternative cooling panel for use with a vacuum chamber in accordance with the invention. In FIG. 5, a cooling panel is shown having an external flange 11 that is in contact with the end surfaces of the flanges 21 and 31, and having a partition portion 17 that is not in contact with the end surfaces of the flanges 21 and 31. The partition 17 has multiple apertures 15 formed therethrough that function in much that same way as the openings of the embodiment of the invention that is discussed above.

In another embodiment of the invention, the cooling panel has an external frame that is in contact with the end surfaces of the flanges 21 and 31, and that has a partition that is not in contact with the end surfaces of the flanges 21 and 31. Apertures of a selected size are formed through the partition. Multiple dips and bumps are formed on the inner peripheral surfaces of the apertures to increase the heat-dissipating area. Accordingly, the invention is not limited to a particular opening shape.

Figure 6:
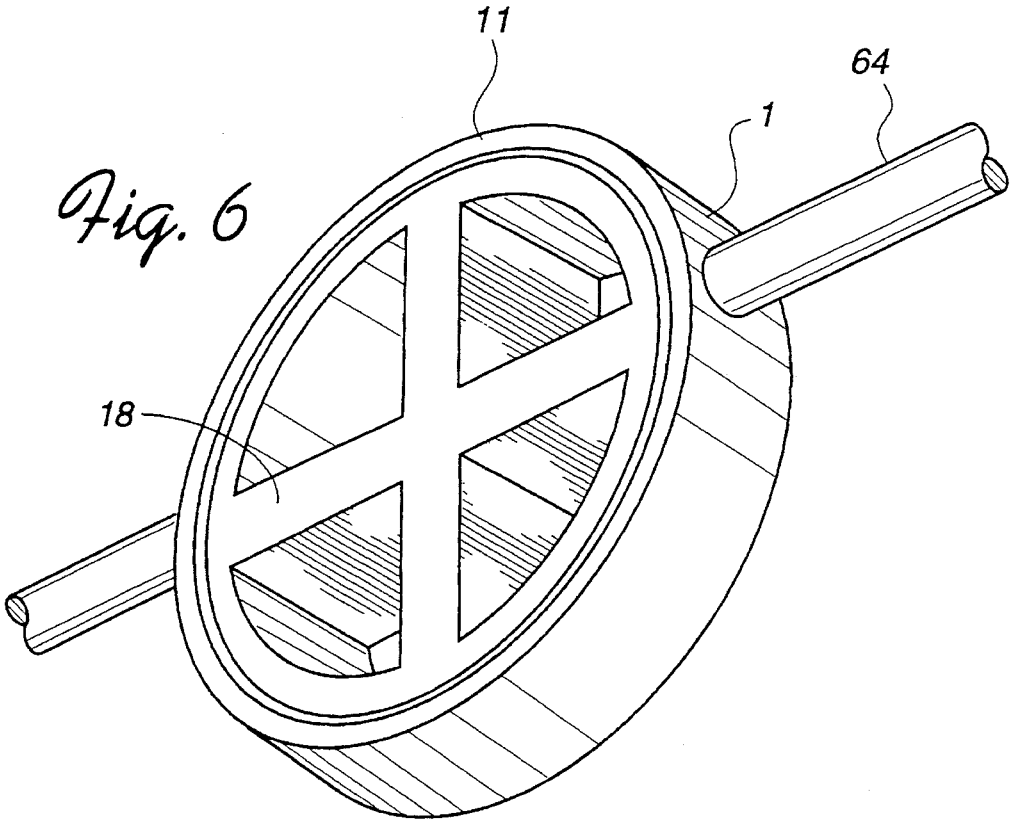
FIG. 6 is an oblique view of another alternative cooling panel for use with a vacuum chamber in accordance with the invention.

FIG. 6 is an oblique view of another alternative cooling panel for use with a vacuum chamber in accordance with the invention. As described above, a cooling pipe is arranged on the peripheral surface of the cooling panel 1 and a coolant is circulated in the cooling pipe to remove heat from cooling panel. In the embodiment of FIG. 6, holes are drilled in the cross-shaped partition 18 inside the cooling panel to form an integrated cooling pipe that is connected to a pipe 64 through which a coolant is circulated. Heat is transferred from the fluid that flows between the vacuum chamber and the cryopump to the cooling panel, and the heat thus collected is removed from the interior of cooling panel partition 18 by the coolant flowing within the cooling panel.

Although the invention is described herein with reference to the preferred embodiment, one skilled in the art will readily appreciate that other applications may be substituted for those set forth herein without departing from the spirit and scope of the present invention. For example, the invention is not limited to a cryopump, and may also be used when the vacuum chamber is evacuated by other types of pumps. Accordingly, the invention should only be limited by the claims included below.

We claim:

1. An apparatus for cooling a vacuum structure that includes a vacuum chamber and a vacuum pump, comprising:

a central cooling panel positioned between a vacuum chamber flange and a suction pump flange, said cooling panel having at least one opening formed therethrough and adapted to pass a fluid flow between said vacuum chamber and said suction pump;

at least one spoke projecting radially from said central cooling panel; and cooling means adapted to cool said cooling panel.

2. The apparatus of claim 1, further comprising:

a cooling pipe arranged in contact with an exposed portion of a cooling panel outer surface; and coolant feed means for circulating a coolant in said cooling pipe.

3. The apparatus of claim 1, said cooling means further comprising:

a cooling pipe opening inside said cooling panel; and coolant feed means for circulating a coolant in said cooling pipe.

4. An apparatus for cooling a vacuum structure that includes a vacuum chamber and a vacuum pump, comprising:

a cooling panel positioned between a vacuum chamber flange and a suction pump flange, said cooling panel having at least one opening formed therethrough and adapted to pass a fluid flow between said vacuum chamber and said suction pump;

cooling means adapted to cool said cooling panel; and a partition with multiple apertures having inner peripheral surfaces formed through said cooling panel.

5. The apparatus of claim 4, wherein multiple dips and bumps are formed on said inner peripheral surfaces of said apertures.

6. An apparatus for cooling a vacuum structure that includes a vacuum chamber and a vacuum pump, comprising:

a cooling panel positioned between a vacuum chamber flange and a suction pump flange said cooling panel having at least one opening formed therethrough and adapted to pass a fluid flow between said vacuum chamber and said suction pump;

cooling means adapted to cool said cooling panel; and a cross-shaped partition inside said cooling panel, said partition defining tubes to form an integrated cooling pipe connected to said coolant feed means.

7. An apparatus for cooling a vacuum structure that includes a vacuum chamber and a vacuum pump, comprising:

a cooling panel positioned between a vacuum chamber flange and a suction pump flange said cooling panel having at least one opening formed therethrough and adapted to pass a fluid flow between said vacuum chamber and said suction pump;

cooling means adapted to cool said cooling panel; and ring-shaped bumps on a cooling panel outer surface, said ring-shaped bumps adapted for complementary engagement with grooves formed on said vacuum chamber flange and on said suction pump flange, wherein said complementary engagement of said bumps with said grooves seals said cooling panel between said vacuum chamber flange and said suction pump flange.

8. An apparatus for cooling a vacuum structure that includes a vacuum chamber and a vacuum pump, comprising:

a cooling panel positioned between a vacuum chamber flange and a suction pump flange said cooling panel having at least one opening formed therethrough and adapted to pass a fluid flow between said vacuum chamber and said suction pump;

cooling means adapted to cool said cooling panel; and ring-shaped bumps on said cooling panel outer surface, said ring-shaped bumps adapted for complementary engagement with grooves formed on said vacuum chamber flange and on said suction pump flange, wherein said complementary engagement of said bumps against said grooves seals said cooling panel between said vacuum chamber flange and said suction pump flange.

9. The apparatus of claim 8, further comprising:

a cooling pipe arranged in contact with an exposed portion of a cooling panel outer surface; and coolant feed means for circulating a coolant in said cooling pipe.

10. The apparatus of claim 8, said cooling means further comprising:

a cooling pipe opening inside said cooling panel; and coolant feed means for circulating a coolant in said cooling pipe.

11. The apparatus of claim 8, said cooling panel further comprising:

a central panel; and at least one spoke projecting radially from said central panel.

12. The apparatus of claim 8, said cooling panel further comprising:

a partition having multiple apertures formed therethrough.

13. The apparatus of claim 8, said cooling panel further comprising:

a cross-shaped partition inside said cooling panel, said partition defining tubes joined to said cooling pipe arranged in contact with said exposed portion of said cooling panel outer surface.

* * * * *